US007644963B2

(12) United States Patent
Fan et al.

(10) Patent No.: US 7,644,963 B2
(45) Date of Patent: Jan. 12, 2010

(54) HOOKING DEVICE

(75) Inventors: Chien-Ming Fan, Tu-Cheng (TW); Jung-Hsiang Lee, Tu-Cheng (TW); Chang-Lin Yang, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/615,904

(22) Filed: Dec. 22, 2006

(65) Prior Publication Data

US 2007/0290512 A1 Dec. 20, 2007

(30) Foreign Application Priority Data

Jun. 2, 2006 (CN) ..... 2006 1 0060966

(51) Int. Cl.
*E05C 19/10* (2006.01)
*E05C 19/00* (2006.01)

(52) U.S. Cl. ..... 292/95; 292/121; 292/122; 292/128; 292/DIG. 38; 292/DIG. 69

(58) Field of Classification Search ..... 292/95, 292/121–128, DIG. 38, DIG. 61, DIG. 63, 292/DIG. 69; 361/686
See application file for complete search history.

(56) References Cited

U.S. PATENT DOCUMENTS

| | | | | | |
|---|---|---|---|---|---|
| 93,930 | A | * | 8/1869 | Westcott | 292/128 |
| 680,954 | A | * | 8/1901 | Williams | 292/341.19 |
| 758,441 | A | * | 4/1904 | Harden | 292/78 |
| 1,007,398 | A | * | 10/1911 | Snider | 292/129 |
| 1,133,254 | A | * | 3/1915 | Backus | 292/127 |
| 1,703,556 | A | * | 2/1929 | Stewart | 292/127 |
| 2,741,505 | A | * | 4/1956 | Courney | 292/341.17 |
| 3,455,590 | A | * | 7/1969 | Zerfoss | 292/128 |
| 3,918,751 | A | * | 11/1975 | Blake | 292/126 |
| 4,131,002 | A | * | 12/1978 | Gianelo | 70/84 |
| 4,141,437 | A | | 2/1979 | Roberts | |
| 4,424,993 | A | * | 1/1984 | Shelby et al. | 292/128 |
| 5,217,269 | A | * | 6/1993 | Wiltberger | 292/343 |
| 5,785,362 | A | * | 7/1998 | Nadherny | 292/98 |
| 6,082,786 | A | * | 7/2000 | Stephens et al. | 292/102 |
| 6,364,390 | B1 | * | 4/2002 | Finneman | 296/37.7 |
| 6,618,912 | B1 | | 9/2003 | Chang | |

(Continued)

FOREIGN PATENT DOCUMENTS

DE 3809998 A1 * 10/1989

*Primary Examiner*—Carlos Lugo
(74) *Attorney, Agent, or Firm*—Frank R. Niranjan

(57) ABSTRACT

A hooking device includes a hook for clasping a latching device, a spring mounted to the hook for providing a restoration force to the hook, and a base securing the hook and the spring thereon. The hook includes a main portion, a catch portion, and a pair of shaft portions extending from the other end along opposite direction. The spring includes two winding portions, two first arms extending from ends of the winding portions, the first arms acting on the hook; and two second arms extending from the other ends of the winding portions. The base includes a base plate defining an opening, two supporting plates accommodating the shaft portions, two bearing plates extending from the base plate, the second arms acting on the bearing plate, and an elastic arm extending from the base plate pushing on the other end of the main portion of the hook.

20 Claims, 8 Drawing Sheets

U.S. PATENT DOCUMENTS 6,631,539 B1 10/2003 Chang
6,942,257 B2 * 9/2005 Wong et al. ..... 292/128
7,269,981 B2 * 9/2007 Kwon ..... 68/3 R
7,427,086 B2 * 9/2008 Park et al. ..... 292/95

* cited by examiner

HOOKING DEVICE

BACKGROUND OF THE INVENTION

1. Field of the Invention

The present invention generally relates to hooking devices, and, more particularly, to a hooking device with a torsion spring.

2. Description of Related Art

Along with development of electronic technology, electronic devices are connectable to predetermined auxiliary devices to allow communication between the devices. Besides electronically connection between the electronic devices and the auxiliary devices, extra mechanical connection should be provided for ensuring proper electronic connection and strengthening the connection.

A conventional hooking device that provides mechanical connection includes a hook, a spring, and a shaft. The hook and the spring are assembled, and then finally the shaft is inserted into a though hole defined in the hook to accomplish the whole assembly. However, the spring may easily fly off during the assembly procedure, and the shaft is prone to escape from the though hole when using the hooking device.

Accordingly, a need exists for a hooking device resolving the above problem in the industry.

SUMMARY OF THE INVENTION

According to one aspect, a hooking device includes a hook for clasping a latching device, a spring mounted to the hook for providing a restoration force to the hook, and a base securing the hook and the spring thereon. The hook includes a main portion, a catch portion formed at an end of the main portion; and at least one shaft portion formed at the other end of the main portion. The spring includes at least one winding portion sleeved on the at least one shaft portion; and a first arm and a second arm respectively extending from two ends of the at least one winding portion. One of the first arm and the second arm is attached to the hook. The base includes a base plate defining an opening therein to allow the catch portion and part of the main portion of the hook to protrude therethrough, at least one supporting plate perpendicularly extending from the base plate, the at least one supporting plate accommodating the at least one shaft portion therein, a bearing plate perpendicularly extending from the base plate, and an elastic arm extending from the base plate pushing the other end of the main portion of the hook. The other of the first arm and the second arm resisting against the bearing plate.

According to another aspect, a hooking device, which is coupleable to a latching device, includes a hook for clasping the latching device, a spring mounted to the hook for providing a restoration force to the hook, and a base securing the hook and the spring thereon. The hook includes a main portion, a catch portion formed at one end of the main portion for engaging with the latching device; and a pair of shaft portions extending from the other end of the main portion along opposite direction. The shaft portions define an axis direction of the hook around which the hook rotates to engaging or disengaging the latching device. The spring includes a pair of winding portions sleeved on the shaft portions of the hook, a pair of first arms extending from ends of the winding portions, the first arms acting on the hook; and a pair of second arms extending from the other ends of the winding portions. The base includes a base plate defining an opening therein to allow the catch portion of the hook to protrude therethrough, a pair of supporting plates extending from the base plate accommodating the shaft portions, a pair of bearing plates extending from the base plate, the second arms acting on the bearing plate, and an elastic arm extending from the base plate, the elastic arm pushing on the other end of the main portion of the hook.

Other systems, methods, features, and advantages of the present hooking device will be or become apparent to one with skill in the art upon examination of the following drawings and detailed description. It is intended that all such additional systems, methods, features, and advantages be included within this description, be within the scope of the present apparatus, and be protected by the accompanying claims.

BRIEF DESCRIPTION OF THE DRAWINGS

Many aspects of the present hooking device can be better understood with reference to the following drawings. The components in the drawings are not necessarily drawn to scale, emphasis instead being placed upon clearly illustrating the principles of the present device. Moreover, in the drawings, like reference numerals designate corresponding parts throughout the several views.

DETAILED DESCRIPTION OF THE INVENTION

Reference will now be made to the drawings to describe the preferred embodiments of the present casing, in detail.

Figure 1:
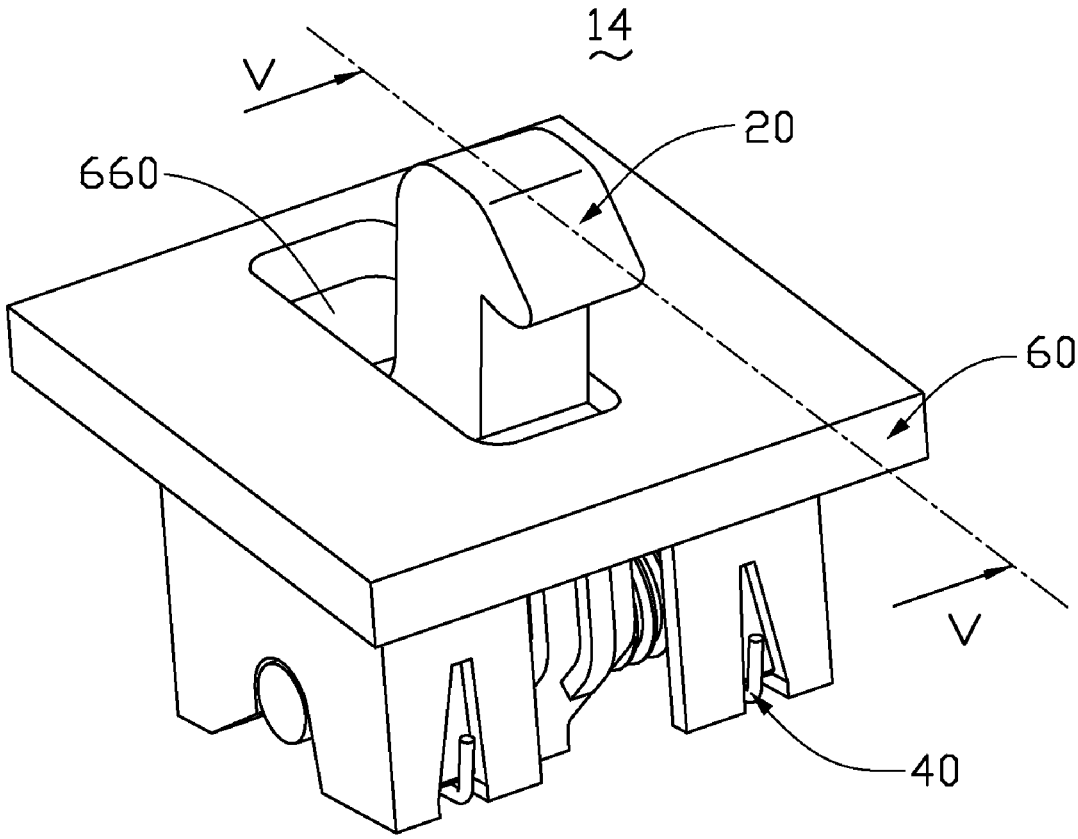
FIG. 1 is an assembled, isometric view of a hooking device in accordance with a first exemplary embodiment, the hooking device including a hook, a spring, and a base.

Referring to FIG. 1, a hooking device 14 in accordance with a first exemplary embodiment is illustrated. The hooking device 14 includes a hook 20, a spring 40, and a base 60. The hook 20 is mounted to the base 60, and the spring 40 engages with the hook 20 to provide a restoration force to the hook 20.

Figure 2:
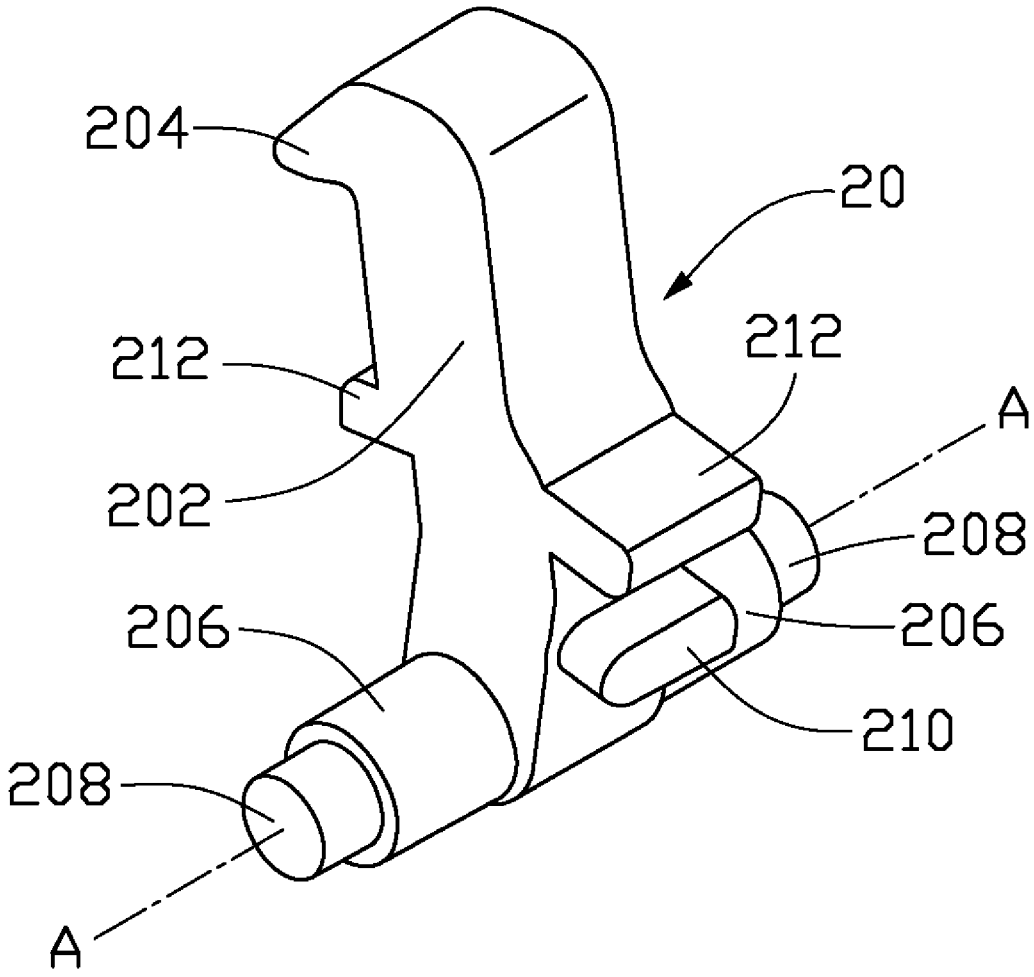
FIG. 2 is an enlarged, isometric view of the hook of FIG. 1.

Referring to FIG. 2, a bar-shaped main portion 202 is provided on the hook 20. A catch portion 204 is formed from a first side at a distal end of the main portion 202, engageable with a latch of a latching device 800 (shown in FIG. 6) or engageable in a opening defined in the latching device 800 (shown in FIG. 6) for clasping the hooking device 14 and the latching device 800 (shown in FIG. 6) together. A pair of shoulder portions 206 extends outwards from the other distal end of the main portion 202 along an axis AA. A pair of shaft portions 208 sequentially extends outwards from the shoulder portions 206 along the axis AA. A baffle portion 210 protrudes from a second side of the main portion 202 opposite to the catch portion 204. A pair of shield portions 212 correspondingly extends from the opposite first and second sides of the main portion 202. The hook 20 is integrally formed.

Figure 3:
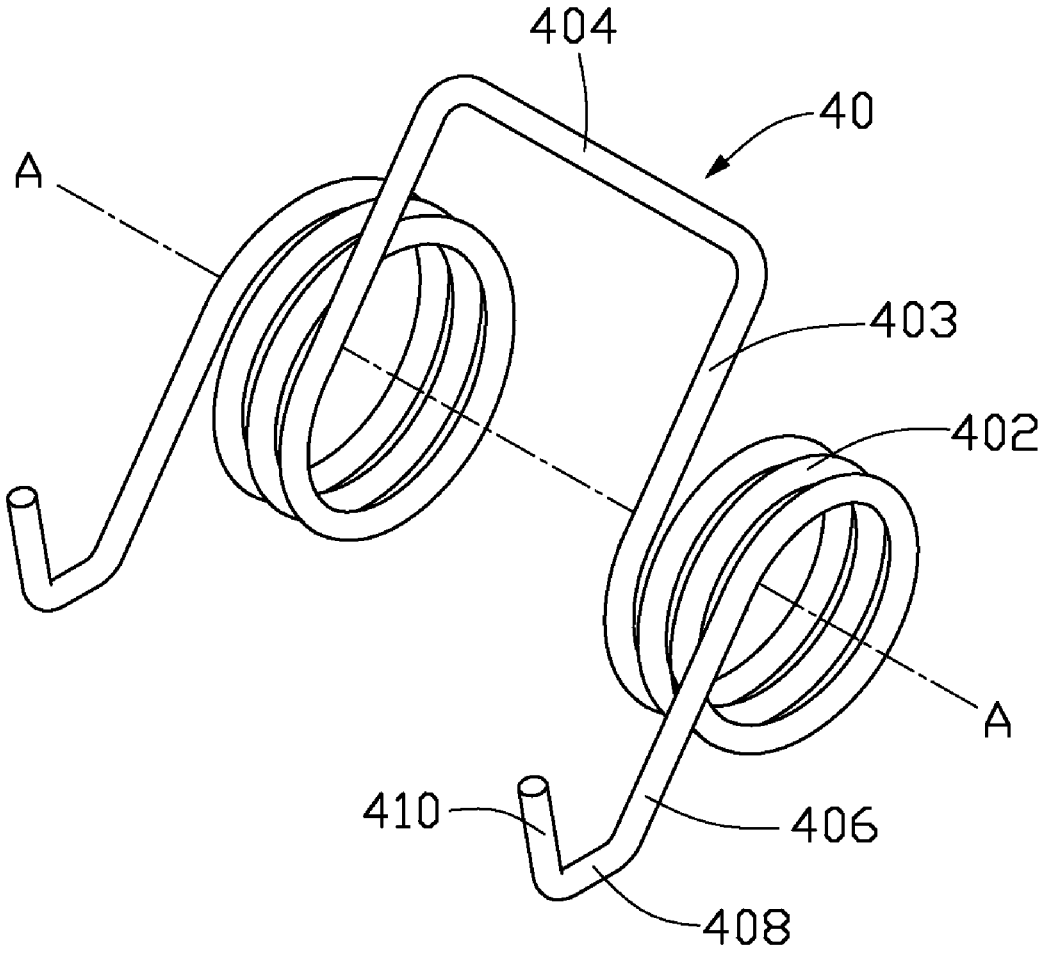
FIG. 3 is an enlarged, isometric view of the spring of FIG. 1.

Referring to FIG. 3, the spring 40 includes a pair of winding portions 402, a pair of first arms 403, a connecting portion 404, a pair of second arms 406, and a pair of resisting portions 408, and a pair of holding portions 410. The axes of rotation of the winding portions 402 are coaxially disposed along the axis AA. The first arms 403, each extending tangentially from one end of the corresponding winding portion 402, are connected via the connecting portion 404. The connecting portion 404 is parallel to the axis AA. The second arms 406, each extend tangentially from an outer end of the winding portion 402, and connect to the resisting portions 408 correspondingly. The resisting portions 408 are bent with respect to the second arms 406. The holding portions 410 extend from the resisting portions 408, and are further bent with respect to the second arms 406.

Figure 4:
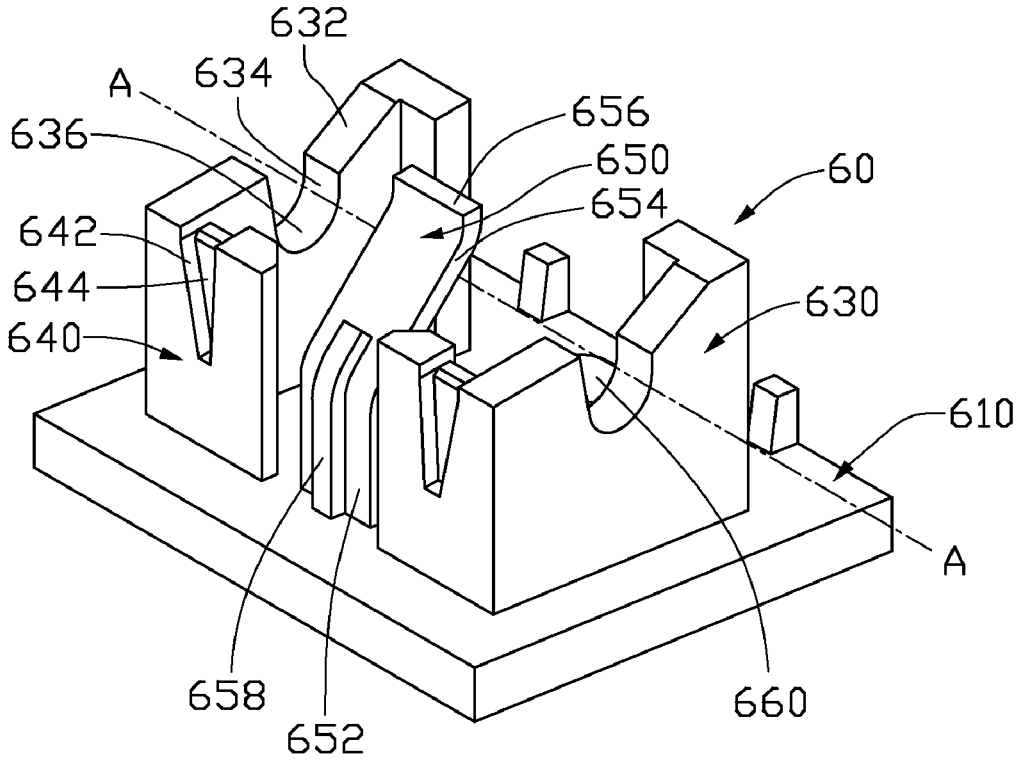
FIG. 4 is an enlarged, isometric view of the base of FIG. 1.
Figure 5:
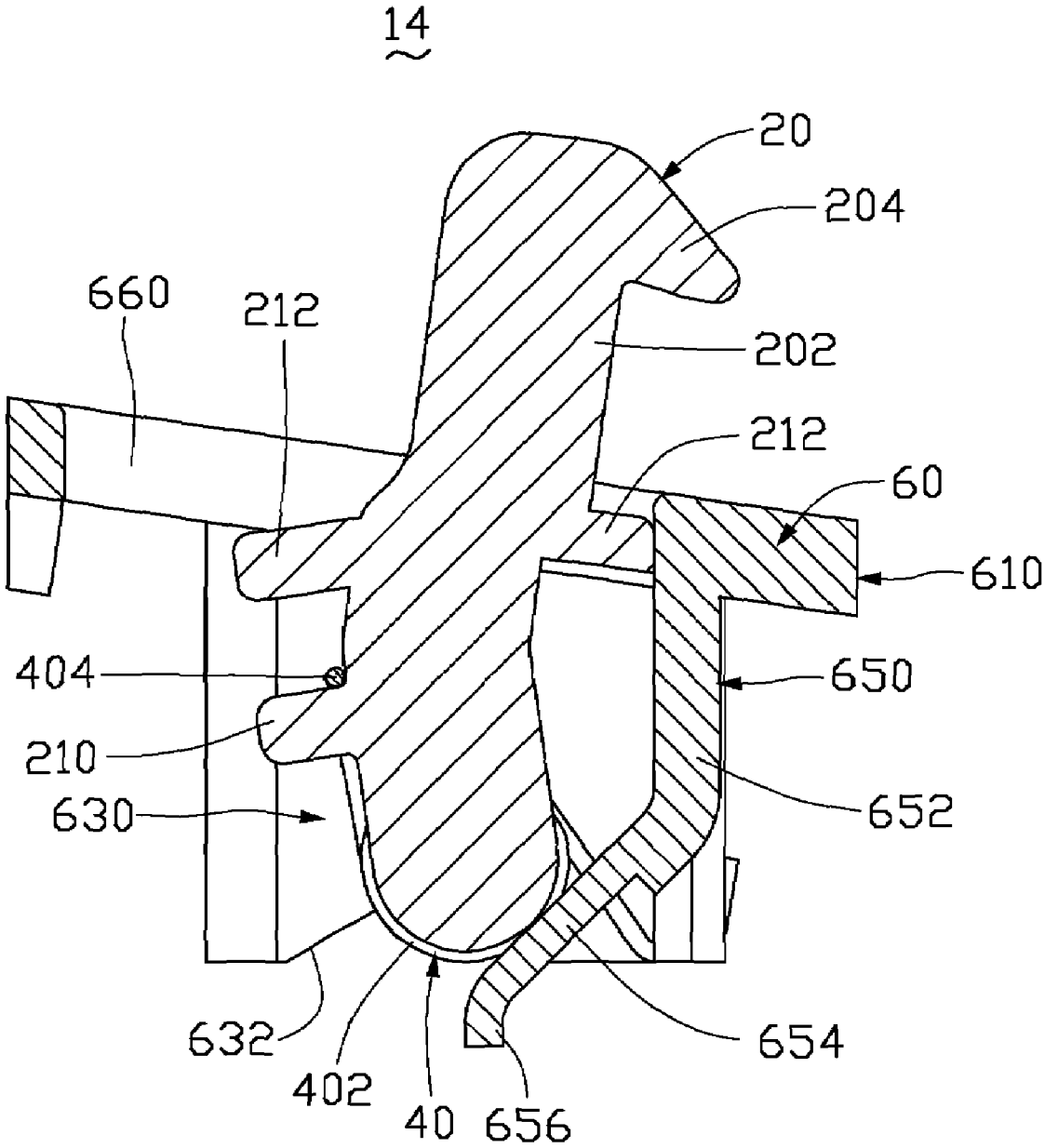
FIG. 5 is a cross-sectional view of the hooking device taken along line V-V in FIG. 1.

Referring to FIG. 4, the base 60 forms a base plate 610 defining an opening 660. The opening 660 is configured to allow a part of the main portion 202 and the catch portion 204 of the hook 20 to protrude through to clasp the latching device 800 (shown in FIG. 6). The part of the main portion 202 and the catch portion 204 is moveable in the opening 660 along a direction perpendicular to the axis direction AA, thus, clasping or releasing the latching device 800 (shown in FIG. 6). A pair of parallel receiving plates 630 extends perpendicularly from the base plate 610 for accommodating the shaft portions 208 of the hook 20. A pair of bearing plates 640, juxtaposed with each other at an interval, extends perpendicularly from the base plate 610 for bearing the holding portions 408 of the spring 40. The bearing plates 640 are parallel to the axis direction AA, and respectively connect with lateral edges of the supporting plates 630. An elastic arm 650 extends from the base plate 610, between the bearing plates 640.

Each of the supporting plates 630 defines an accommodating notch 634 for accommodating the shaft portions 208. The accommodating notches 634 are aligned with the axis AA. A guiding surface 632 is formed at a side of each of the accommodating notches 634, and communicates with an accommodating surface 636 surrounding the accommodating notch 634 correspondingly. The guiding surfaces 632 are formed at an angle to the base plate 610, and opposite to the elastic arm 650 with respect to the axis AA.

Each of the bearing plates 640 defines a V-shaped recess 642 from a free edge, and a V-shaped loading plate 644 is thus formed at a bottom of each recess 642.

The elastic arm 650 sequentially includes a fixing portion 652, a pushing portion 654, and a guiding portion 656. The fixing portion 652 extends perpendicularly from the base plate 610. The pushing portion 654 extends from a free end of the fixing portion 652, and is bent towards the axis AA. The guiding portion 656 extends from a free end of the pushing portion 654, and is bent away from the axis AA. A strengthening rib 658 is formed at a middle of the fixing portion 652, and extends to the pushing portion 654.

Referring to FIG. 1 and FIGS. 5, 6 and 7 an assembly procedure of the hooking device 14 will be detailedly described. The spring 40 is firstly assembled to the hook 20, with the winding portions 402 sleeved onto the shoulder portions 206, and the connecting portion 404 positioned between the baffle portion 210 and the shield portion 212. The connecting portion 404 of the spring is blocked by the baffle portion 210 of the hook 20, and the spring 40 is thus fixed with respect to the hook 20. Subsequently, the hook 20 with the spring 40 is to be assembled to the base 60. The catch portion 204 and the main portion 202 of the hook 20 are moved into the space between the supporting plates 630 and the elastic arm 650. The shaft portions 208 of the hook 20 are placed on the guiding surface 632 of the base 60, and the end of the main portion 202 of the hook 20 is resisted by the guiding portion 656 of the elastic arm 650. The hook 20 is pushed along the guiding surfaces 632, and the elastic arm 650 is deformed away from the axis AA to allow the shaft portions 208 gradually enter the accommodating notched 634 via the guiding surfaces 632. After the shaft portions 208 enter the accommodating notches 634, the elastic arm 650 restores and pushing the end of the main portion 202 to keep the hook 20 in position. At the same time when the shaft portions 208 enters the accommodating notches 634, the resisting portions 408 and the holding portions 410 clasp the loading plate 644. The resisting portions 408 of the hook 20 contact edges of the loading plates 644, and the holding portions 410 are received in the recesses 642. After assembly, the shield portions 212 of the hook 20 respectively cover the ends of the spring 40 extending from the winding portions 402 along different directions, and the hooking device 14 is thus in good appearance.

At rest, the hook 20 protrudes from the opening 660, and clasps the latching device 800. When an external force F is applied, the hook 20 is moved around the axis AA in the opening 660 along the direction perpendicular to the axis AA thus releasing the latching device 800, and be stopped at a position shown in the FIG. 7, whereupon the spring 40 is distorted. Once the external force F is removed, the hook 20 automatically returns to the initial position under the restoration force of the spring 40 applied by the connecting portion 404, as a result, the latching device 800 is clasped by the catch portion.

Figure 6:
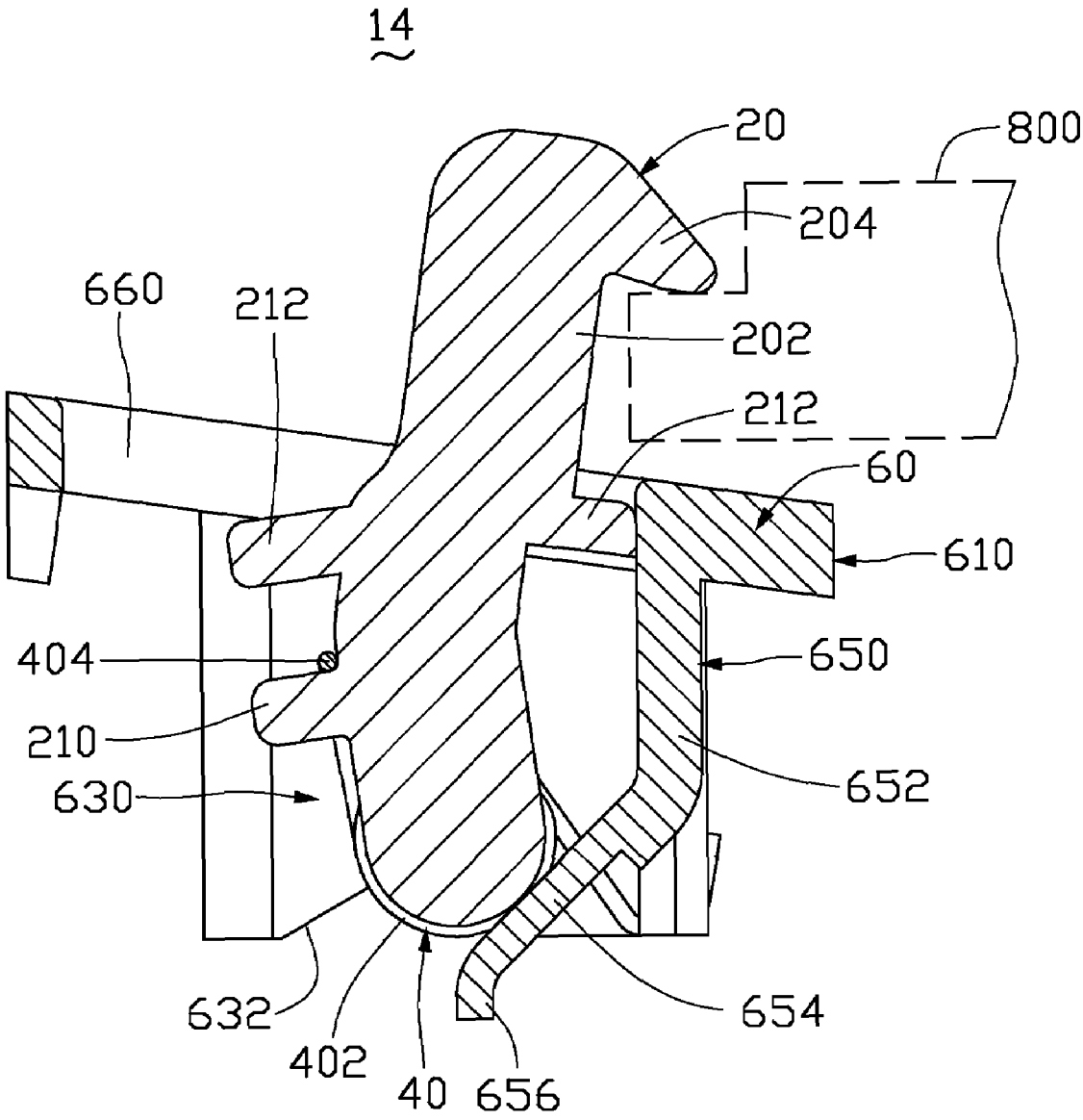
FIGS. 6 and 7 are similar to FIG. 5 but showing releasing of latching devices.
Figure 7:
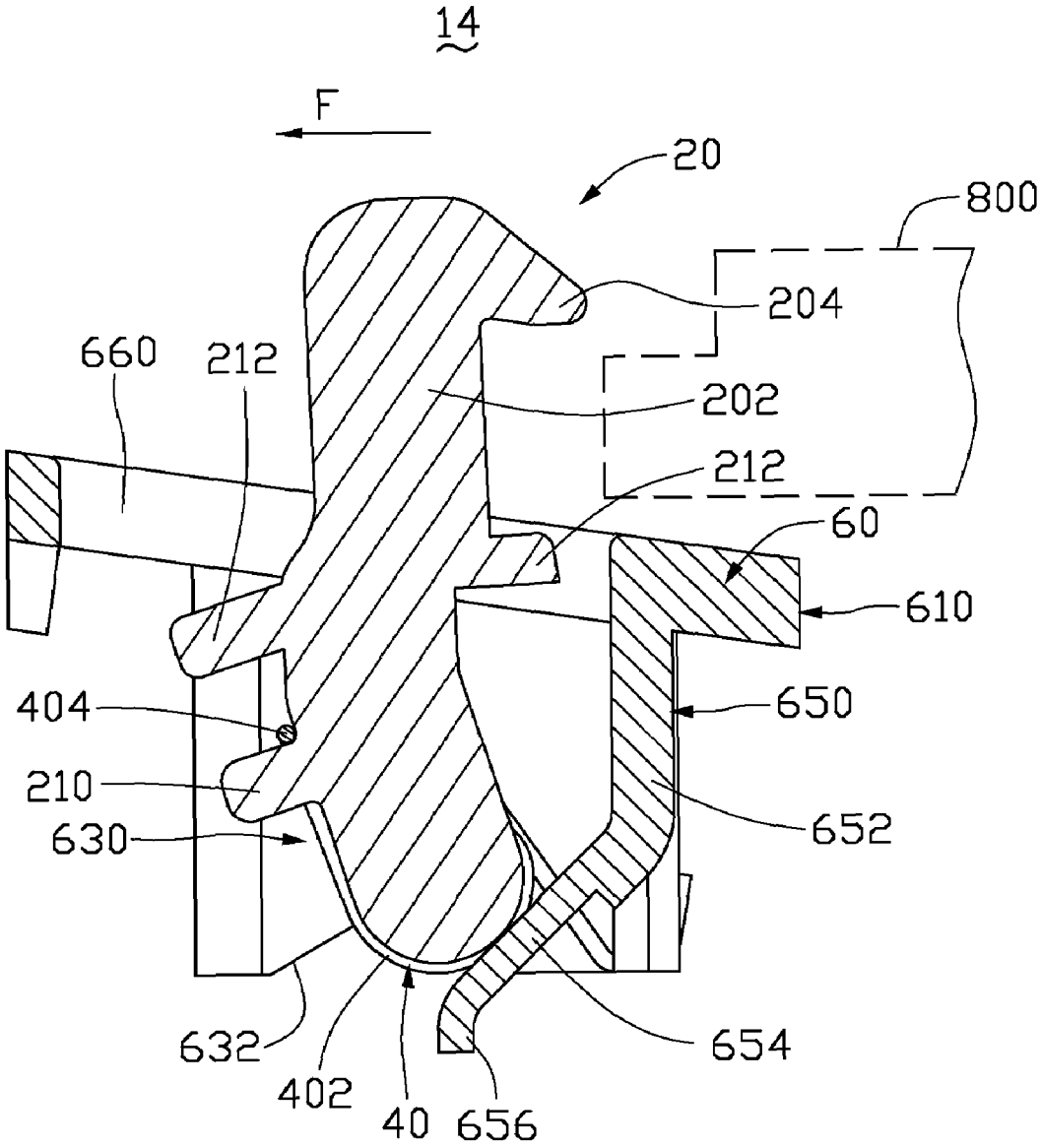
Figure 8:
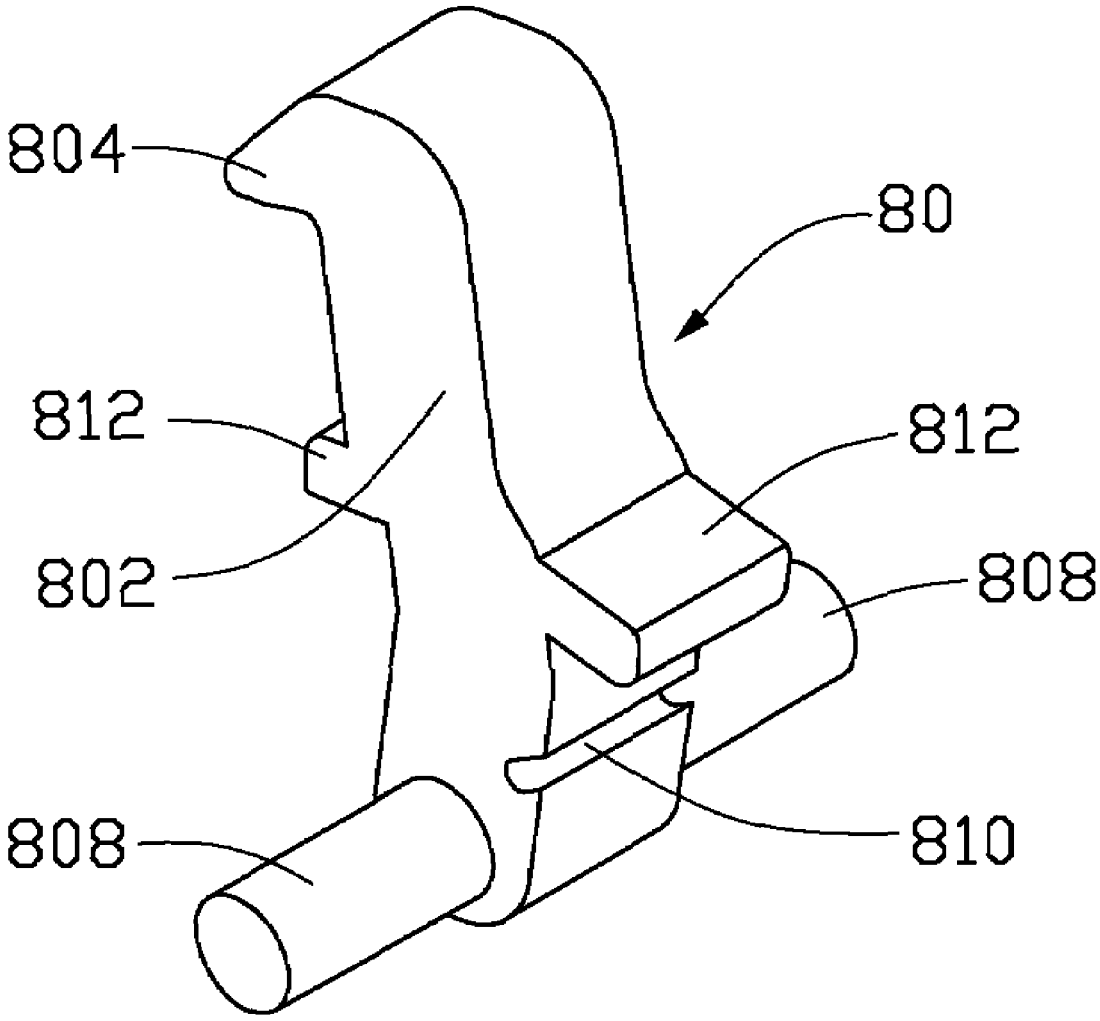
FIG. 8 is an isometric view of a hook in accordance with a second exemplary embodiment.

Referring to FIG. 6, a hook 80 in accordance with another embodiment is shown. Similarly, the hook 80 includes a main portion 802, a catch portion 804, a pair of shaft portions 808, and a pair of shield portions 81 2. Distinctly, the shoulder portions are omitted. In other words, the shaft portions 808 perform as the shoulder portions 206 and the shaft portions 208 of the hook 20 in the first embodiment. Substitutionally, a slot 810 is defined in the main portion 802 to receive the connecting portion 404 of the spring 40 therein, substituting for the baffle portion 210 of the hook 20 in the first embodiment.

As described above, the ends of the winding portions 402 are properly positioned and fixed, and the hooking device 14 is thus in good condition no matter in assembly or in use. The configuration of the hooking device 14 is strengthened with enhanced endurance.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A hooking device for connecting devices together, comprising:

a hook, the hook comprising:

a main portion;

a catch portion which is formed at an end of the main portion; and a pair of shaft portions being formed at the other end of the main portion, the shaft portions defining an axis direction around which the hook rotates;

a spring mounted to the hook for providing a restoration force to the hook when the hook is rotated around the axis direction, the spring comprising:

a pair of winding portions sleeved on the respective shaft portions; and a first arm and a second arm respectively extending from two ends of the winding portions, one of the first arm and the second arm being attached to the hook; and a base securing the hook and the spring thereon, the base comprising:

a base plate which defines an opening therein to allow the catch portion and part of the main portion of the hook to protrude therethrough;

a pair of supporting plates perpendicularly extending from the base plate, to accommodate the shaft portions therein;

a bearing plate perpendicularly extending from and located below the base plate, the other one of the first arm and the second arm resisting against the bearing plate; and an elastic arm extending from the base plate, the elastic arm pushing the other end of the main portion of the hook.

2. The hooking device as claimed in claim 1, wherein the hook forms a baffle portion on the main body positioning the one of the first arm and the second arm attached to the hook, and the baffle portion perpendicularly extends from the main body.

3. The hooking device as claimed in claim 1, wherein the main portion of the hook defines a slot which receives therein the one of the first arm and the second arm attached to the hook.

4. The hooking device as claimed in claim 1, wherein the base plate defines a pair of accommodating notches that receive the shaft portions therein.

5. The hooking device as claimed in claim 4, wherein a pair of guiding surfaces are formed on the base plate, and the guiding surfaces communicate with respective accommodating surfaces surrounding the accommodating notches.

6. The hooking device as claimed in claim 5, wherein the guiding surfaces are at an oblique angle with respect to the base plate, and at an opposite side to the elastic arm with respect to the shaft portions.

7. The hooking device as claimed in claim 1, wherein the spring comprises a pair of resisting portions and a pair of holding portions, and the resisting portions and the holding portions are bent with respect to the other arm of the first arm and the second arm.

8. The hooking device as claimed in claim 7, wherein the resisting portions resist on the bearing plate, and the holding portions hold the base plate.

9. The hooking device as claimed in claim 8, wherein the bearing plate defines a recess accommodating the holding portions therein.

10. The hooking device as claimed in claim 1, wherein the elastic arm comprises a fixing portion and a pushing portion, the fixing portion connects to the base plate, and the pushing portion pushes on the other end of the main portion of the hook.

11. The hooking device as claimed in claim 10, wherein the elastic arm comprises a strengthening rib, and the rib is formed at a middle of the fixing portion and extends to the pushing portion.

12. The hooking device as claimed in claim 1, wherein the hook is integrally formed.

13. A hooking device for connecting devices together, comprising:

a hook, the hook comprising:

a main portion;

a catch portion formed at one end of the main portion; and a pair of shaft portions extending from the other end of the main portion along opposite directions, the shaft portions defining an axis direction of the hook around which the hook rotates;

a spring mounted to the hook for providing a restoration force to the hook when the hook is rotated around the axis direction, the spring comprising:

a pair of winding portions sleeved on the shaft portions of the hook; and a pair of first arms extending from ends of the winding portions, the first arms acting on the hook; and a pair of second arms extending from the other ends of the winding portions; and a base securing the hook and the spring thereon, the base comprising:

a base plate defining an opening therein to allow the catch portion of the hook to protrude therethrough;

a pair of supporting plates extending from the base plate accommodating the shaft portions;

a pair of bearing plates perpendicularly extending from and located below the base plate, the second arms acting on the bearing plates; and an elastic arm extending from the base plate pushing on the other end of the main portion of the hook.

14. The hooking device as claimed in claim 13, wherein the elastic arm comprises a fixing portion and a pushing portion, the fixing portion connects to the base plate, and the pushing portion pushes on the other end of the main portion of the hook.

15. The hooking device as claimed in claim 14, wherein the elastic arm comprises a strengthening rib, and the rib is formed at a middle of the fixing portion and extends to the pushing portion.

16. The hooking device as claimed in claim 13, wherein the spring includes a pair of resisting portions and a pair of holding portions, and the resisting portions and the holding portions are bent with respect to the other arm of the first arm and the second arm.

17. The hooking device as claimed in claim 16, wherein the spring comprises a connecting portion connecting the first arms.

18. The hooking device as claimed in claim 16, wherein the hook forms a baffle portion on the main portion positioning the connecting portion of the spring, and the baffle portion perpendicularly extends from the main body.

19. The hooking device as claimed in claim 16, wherein the main portion defines a slot therein accommodating the connecting portion of the spring therein.

20. The hooking device as claimed in claim 13, wherein the hook is integrally formed.

* * * * *